US011004376B2

(12) United States Patent
Choi et al.

(10) Patent No.: US 11,004,376 B2
(45) Date of Patent: May 11, 2021

(54) SCAN DRIVER AND DISPLAY DEVICE INCLUDING THE SAME

(71) Applicant: Samsung Display Co., Ltd., Yongin-si (KR)

(72) Inventors: Yang Hwa Choi, Yongin-si (KR); Sun Kwang Kim, Yongin-si (KR); Sang Jin Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/680,414

(22) Filed: Nov. 11, 2019

(65) Prior Publication Data

US 2020/0202761 A1 Jun. 25, 2020

(30) Foreign Application Priority Data

Dec. 20, 2018 (KR) ..... 10-2018-0166337

(51) Int. Cl.
*G09G 3/32* (2016.01)
*G09G 3/20* (2006.01)

(52) U.S. Cl.
CPC ..... *G09G 3/20* (2013.01); *G09G 2310/0267* (2013.01); *G09G 2310/0291* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 8,866,859 | B2 | 10/2014 | Chung et al. | |
| 10,121,434 | B2 | 11/2018 | Park et al. | |
| 2012/0081409 | A1* | 4/2012 | Chung | G09G 3/3677 345/690 |
| 2017/0206840 | A1* | 7/2017 | Cho | G09G 3/3266 |
| 2020/0184898 | A1 | 6/2020 | Choi et al. | |
| 2020/0193912 | A1 | 6/2020 | Park et al. | |
| 2020/0258446 | A1 | 8/2020 | Choi et al. | |

FOREIGN PATENT DOCUMENTS

| | | |
|---|---|---|
| KR | 10-2016-0122907 | 10/2016 |
| KR | 10-1804315 | 1/2018 |
| KR | 10-2018-0031879 | 3/2018 |
| KR | 10-2020-0071206 | 6/2020 |
| KR | 10-2020-0072635 | 6/2020 |
| KR | 10-2020-0083763 | 7/2020 |
| KR | 10-2020-0097382 | 8/2020 |
| KR | 10-2020-0100247 | 8/2020 |

* cited by examiner

*Primary Examiner* — Joseph R Haley
(74) *Attorney, Agent, or Firm* — H.C. Park & Associates, PLC

(57) ABSTRACT

A scan driver for a display device includes scan signal output circuits connected to each other through scan lines. Each scan signal output circuit includes: a drive circuit to apply a first drive signal to a first drive node, to apply a second drive signal to a second drive node, and to apply a connection signal to a connection signal output node based on i) an input signal which is one of either a scan start signal or a scan signal applied by another scan signal output circuit, ii) a clock signal, and iii) an on-level voltage; and a buffer circuit to receive the connection signal, the first drive signal, and the second drive signal from the drive circuit, and to output one of scan signals to one of the scan lines based on the first drive signal, the second drive signal, and the clock signal.

18 Claims, 11 Drawing Sheets

SCAN DRIVER AND DISPLAY DEVICE INCLUDING THE SAME

CROSS-REFERENCE TO RELATED APPLICATION

This application claims priority from and the benefit of Korean Patent Application No. 10-2018-0166337, filed on Dec. 20, 2018, which is hereby incorporated by reference for all purposes as if fully set forth herein.

BACKGROUND

Field

Exemplary implementations of the invention relate generally to a scan driver and a display device including the same and, more specifically, to a scan driver and a display device including the same capable of sensing characteristics of display elements during the porch period of the display.

Discussion of the Background

In general, a display device includes a display panel, a scan driver, a data driver, a timing controller, and the like. At this time, the scan driver supplies scan signals, each of which may be either a scan-on signal or a scan-off signal, to the display panel through scan lines.

To this end, the scan driver includes sequentially connected scan signal output circuits, and each of the scan signal output circuits is configured by oxide thin film transistors.

In recent years, the display device compensates for deterioration of a pixel and a change in characteristic (e.g., a change in characteristic depending on a temperature) by sensing information related to the mobility of a drive transistor included in a pixel circuit or information related to the deterioration of a light emitting element. At this time, the scan driver may generate and output the scan signals for a display operation, the mobility sensing operation, and the deterioration sensing operation of the light emitting element.

The above information disclosed in this Background section is only for understanding of the background of the inventive concepts, and, therefore, it may contain information that does not constitute prior art.

SUMMARY

Scan drivers and display devices including the same constructed according to the principles and exemplary implementations of the invention are capable of accurately sensing characteristics of the display elements, which may be pixels, such as mobility and deterioration. Furthermore, the sensing operation may be accomplished in a relatively short time, such as during the porch period of the display.

Scan drivers and display devices including the same constructed according to the principles and exemplary implementations of the invention are capable of reducing the voltage stress applied to some of the transistors included in the scan drivers.

Additional features of the inventive concepts will be set forth in the description which follows, and in part will be apparent from the description, or may be learned by practice of the inventive concepts.

A scan driver for a display device constructed according to one or more embodiments includes: first to n-th (where n is a natural number greater than or equal to 2) scan signal output circuits to apply scan signals to scan lines, respectively, the first to n-th scan signal output circuits being connected to each other through the scan lines, wherein each of the first to n-th scan signal output circuits includes: a drive circuit to apply a first drive signal to a first drive node, to apply a second drive signal to a second drive node, and to apply a connection signal to a connection signal output node based on i) an input signal which is one of either a scan start signal or a scan signal applied by another scan signal output circuit, ii) a clock signal, and iii) an on-level voltage; and a buffer circuit to receive the connection signal, the first drive signal, and the second drive signal from the drive circuit, and to output one of the scan signals to one of the scan lines based on the first drive signal, the second drive signal, and the clock signal.

The buffer circuit may be operable to select one of the scan lines for mobility sensing by storing a sampling voltage at a sampling node based on a sensing-on signal.

The scan driver may be operable to apply scan signals to frames, each of which has a display period and a porch period; the first to n-th scan signal output circuits may output the scan signals through the scan lines during the display period; and at least one of the first to n-th scan signal output circuits may output at least one of the scan signals through at least one of the scan lines during the porch period.

The first to n-th scan signal output circuits may be connected to pixels through the scan lines, the pixels being operable to display an image during a frame having a display period and a porch period; the buffer circuit may be operable to select one of the scan lines by transferring the connection signal of another one of the first to n-th scan signal output circuits to a sampling node to charge the sampling node in response to a control signal enabled in the display period; and the buffer circuit may be operable to output the one of the scan signals to the one of the scan lines in response to a voltage of the sampling node in the porch period.

The clock signal may include a first clock signal, a second clock signal, a third clock signal, and a fourth clock signal, and each of the first to n-th scan signal output circuits may receive at least two of the first to fourth clock signals.

The drive circuit included in the m-th (where m is a natural number smaller than n) scan signal output circuit to receive the first clock signal and the third clock signal may include: a third transistor having a first terminal for receiving the first clock signal, a second terminal connected to a second node, and a gate terminal connected to a first node; a fourth transistor having a first terminal that to receive the on-level voltage, a second terminal connected to the first node, and a gate terminal to receive the input signal; a fifth transistor having a first terminal connected to the second node, a second terminal to receive the on-level voltage, and a gate terminal to receive the first clock signal; a sixth transistor having a first terminal connected to the second node, a second terminal to receive the on-level voltage, and a gate terminal connected to the second node; a seventh transistor having a first terminal connected to the first node, a second terminal, and a gate terminal to receive the third clock signal; an eighth transistor having a first terminal connected to the second terminal of the seventh transistor, a second terminal connected to the connection signal output node, and a gate terminal connected to the second node; a ninth transistor having a first terminal connected to the first node, a second terminal connected to the connection signal output node, and a gate terminal to receive the connection signal of another one of the first to n-th scan signal output circuits; a first capacitor having a first terminal connected to the first node and a second terminal connected to the connection signal output node; a tenth transistor having a first terminal to receive the third clock signal, a second terminal connected to the connection signal output node, and a gate terminal connected to the first node; an eleventh transistor having a first terminal connected to the connection signal output node, a second terminal to receive an auxiliary off-level voltage, and a gate terminal connected to the second node; a second capacitor having a first terminal connected to the second node and a second terminal to receive the auxiliary off-level voltage; a twelfth transistor having a first terminal connected to the first node, a second terminal connected to the first drive node, and a gate terminal to receive the display-on signal; and a thirteenth transistor having a first terminal connected to the second node, a second terminal connected to the second drive node, and a gate terminal to receive the display-on signal.

The fourth transistor included in the first scan signal output circuit may receive the scan start signal as the input signal, and the fourth transistors that are included in the second to n-th scan signal output circuits may be operable to receive scan signals applied by the first to n−1-th scan signal output circuits, respectively, as the input signal.

The fourth transistor included in the first and second scan signal output circuits may be operable to receive the scan start signal as the input signal, and the fourth transistor included in the i-th (where i is a natural number greater than or equal to 3 and smaller than or equal to n) scan signal output circuit may be operable to receive a scan signal applied by the i−2-th scan signal output circuit as the input signal.

The buffer circuit included in the m-th scan signal output circuit may include: a fourteenth transistor having a first terminal to receive the connection signal of the another one of the first to n-th scan signal output circuits, a second terminal connected to a sampling node, and a gate terminal to receive a sensing-on signal; a third capacitor having a first terminal connected to the sampling node and a second terminal connected to the auxiliary off-level voltage; a fourth capacitor having a first terminal connected to the sampling node and a second terminal to receive the sensing-on signal; a fifteenth transistor having a first terminal to receive a sensing mode activation clock signal, a second terminal connected to a third node, and a gate terminal connected to the sampling node; a sixteenth transistor having a first terminal connected to the second drive node, a second terminal, and a gate terminal to receive the sensing mode activation clock signal; a seventeenth transistor having a first terminal connected to the second terminal of the sixteenth transistor, a second terminal connected to an off-level voltage higher than the auxiliary off-level voltage, and a gate terminal connected to the sampling node; an eighteenth transistor having a first terminal connected to the third node, a second terminal connected to the first drive node, and a gate terminal connected to the sampling node; a nineteenth transistor having a first terminal connected to the third node, a second terminal connected to the connection signal output node, and a gate terminal connected to the first drive node; a first transistor having a first terminal to receive a third clock signal, a second terminal to output one of the scan signals, and a gate terminal connected the first drive node; and a second transistor having a first terminal to output one of the scan signals, a second terminal connected to the off-level voltage, and a gate terminal connected to the second drive node.

The m+1-th scan signal output circuit may be operable to receive the second clock signal and the fourth clock signal.

A display device constructed according to one or more embodiments includes: a display unit including a plurality of pixels; a data driver to supply the display unit with data signals; a scan driver to supply the display unit with scan signals; and a timing controller to control the data driver and the scan driver, wherein the scan driver includes first through n-th (where n is a natural number greater than or equal to 2) scan signal output circuits to apply the scan signals to the display unit through scan lines, respectively. Each of the first to n-th scan signal output circuits includes: a drive circuit to apply a first drive signal to a first drive node, to apply a second drive signal to a second drive node, and to apply a connection signal to a connection signal output node based on i) an input signal which is one of either a scan start signal or a scan signal applied by another scan signal output circuit, ii) a clock signal, and iii) an on-level voltage; and a buffer circuit to receive the connection signal, the first drive signal, and the second drive signal from the drive circuit, and to output one of the scan signals to one of the scan lines based on the first drive signal, the second drive signal, and the clock signal.

The display unit may be operable to display an image during a frame having a display period and a porch period; the buffer circuit may be operable to select one of the scan lines by transferring the connection signal of another one of the first to n-th scan signal output circuits to a sampling node to charge the sampling node in response to a control signal enabled in the display period; and the buffer circuit may further be operable to output one of the scan signals to the one of the scan lines in response to a voltage of the sampling node in the porch period.

The display unit may be operable to display an image during a frame having a display period and a porch period when the display device is in a display mode; the first to n-th scan signal output circuits may be operable to output the scan signals through the scan lines during the display period; and at least one of the first to n-th scan signal output circuits may be operable to output at least one of the scan signals through at least one of the scan lines during the porch period.

When the display device is in a non-display mode, the frame further may include a threshold voltage sensing period, and the first to n-th scan signal output circuits may be operable to sequentially output the scan signals through the scan lines during the threshold voltage sensing period.

The timing controller may be operable to supply the scan driver with the clock signal including a first clock signal, a second clock signal, a third clock signal, and a fourth clock signal, and each of the first to n-th scan signal output circuits may be operable to receive at least two clock signals of the first to fourth clock signals.

The drive circuit included in the m-th (where m is a natural number smaller than n) scan signal output circuit operable to receive the first clock signal and the third clock signal may include: a third transistor having a first terminal to receive the first clock signal, a second terminal connected to a second node, and a gate terminal connected to a first node; a fourth transistor having a first terminal to receive the on-level voltage, a second terminal connected to the first node, and a gate terminal to receive the input signal; a fifth transistor having a first terminal connected to the second node, a second terminal to receive the on-level voltage, and a gate terminal to receive the first clock signal; a sixth transistor having a first terminal connected to the second node, a second terminal to receive the on-level voltage, and a gate terminal connected to the second node; a seventh transistor having a first terminal connected to the first node, a second terminal, and a gate terminal to receive the third clock signal; an eighth transistor having a first terminal connected to the second terminal of the seventh transistor, a second terminal connected to the connection signal output node, and a gate terminal connected to the second node; a ninth transistor having a first terminal connected to the first node, a second terminal connected to the connection signal output node, and a gate terminal to receive the connection signal of another one of the first to n-th scan signal output circuits; a first capacitor having a first terminal connected to the first node and a second terminal connected to the connection signal output node; a tenth transistor having a first terminal to receive the third clock signal, a second terminal connected to the connection signal output node, and a gate terminal connected to the first node; an eleventh transistor having a first terminal connected to the connection signal output node, a second terminal to receive an auxiliary off-level voltage, and a gate terminal connected to the second node; a second capacitor having a first terminal connected to the second node and a second terminal to receive the auxiliary off-level voltage; a twelfth transistor having a first terminal connected to the first node, a second terminal connected to the first drive node, and a gate terminal to receive the display-on signal; and a thirteenth transistor having a first terminal connected to the second node, a second terminal connected to the second drive node, and a gate terminal to receive the display-on signal.

The fourth transistor included in the first scan signal output circuit may be operable to receive the scan start signal as the input signal, and the fourth transistors that are included in the second to n-th scan signal output circuits may be operable to receive scan signals applied by the first to n−1-th scan signal output circuits, respectively, as the input signal.

The fourth transistor included in the first and second scan signal output circuits may be operable to receive the scan start signal as the input signal, and the fourth transistor included in the i-th (where i is a natural number greater than or equal to 3 and smaller than or equal to n) scan signal output circuit may be operable to receive a scan signal applied by the i−2-th scan signal output circuit as the input signal.

The buffer circuit included in the m-th scan signal output circuit may include: a fourteenth transistor having a first terminal to receive the connection signal of the another one of the first to n-th scan signal output circuits, a second terminal connected to a sampling node, and a gate terminal to receive a sensing-on signal; a third capacitor having a first terminal connected to the sampling node and a second terminal connected to the auxiliary off-level voltage; a fourth capacitor having a first terminal connected to the sampling node and a second terminal to receive the sensing-on signal; a fifteenth transistor having a first terminal to receive a sensing mode activation clock signal, a second terminal connected to a third node, and a gate terminal connected to the sampling node; a sixteenth transistor having a first terminal connected to the second drive node, a second terminal, and a gate terminal to receive the sensing mode activation clock signal; a seventeenth transistor having a first terminal connected to the second terminal of the sixteenth transistor, a second terminal connected to an off-level voltage higher than the auxiliary off-level voltage, and a gate terminal connected to the sampling node; an eighteenth transistor having a first terminal connected to the third node, a second terminal connected to the first drive node, and a gate terminal connected to the sampling node; a nineteenth transistor having a first terminal connected to the third node, a second terminal that is connected to the connection signal output node, and a gate terminal connected to the first drive node; a first transistor having a first terminal to receive a third clock signal, a second terminal to output the one of the scan signals, and a gate terminal connected the first drive node; and a second transistor having a first terminal to output the one of the scan signals, a second terminal connected to the off-level voltage, and a gate terminal connected to the second drive node.

Each of the plurality of pixels may include: a light emitting element; a drive transistor to control the amount of current flowing through the light emitting element based on one of the data signals; a switching transistor having a gate terminal connected to one of the scan lines to receive the data signal; and a sensing transistor having a gate terminal connected to one of the scan lines and being connected to a first terminal of the light emitting element.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
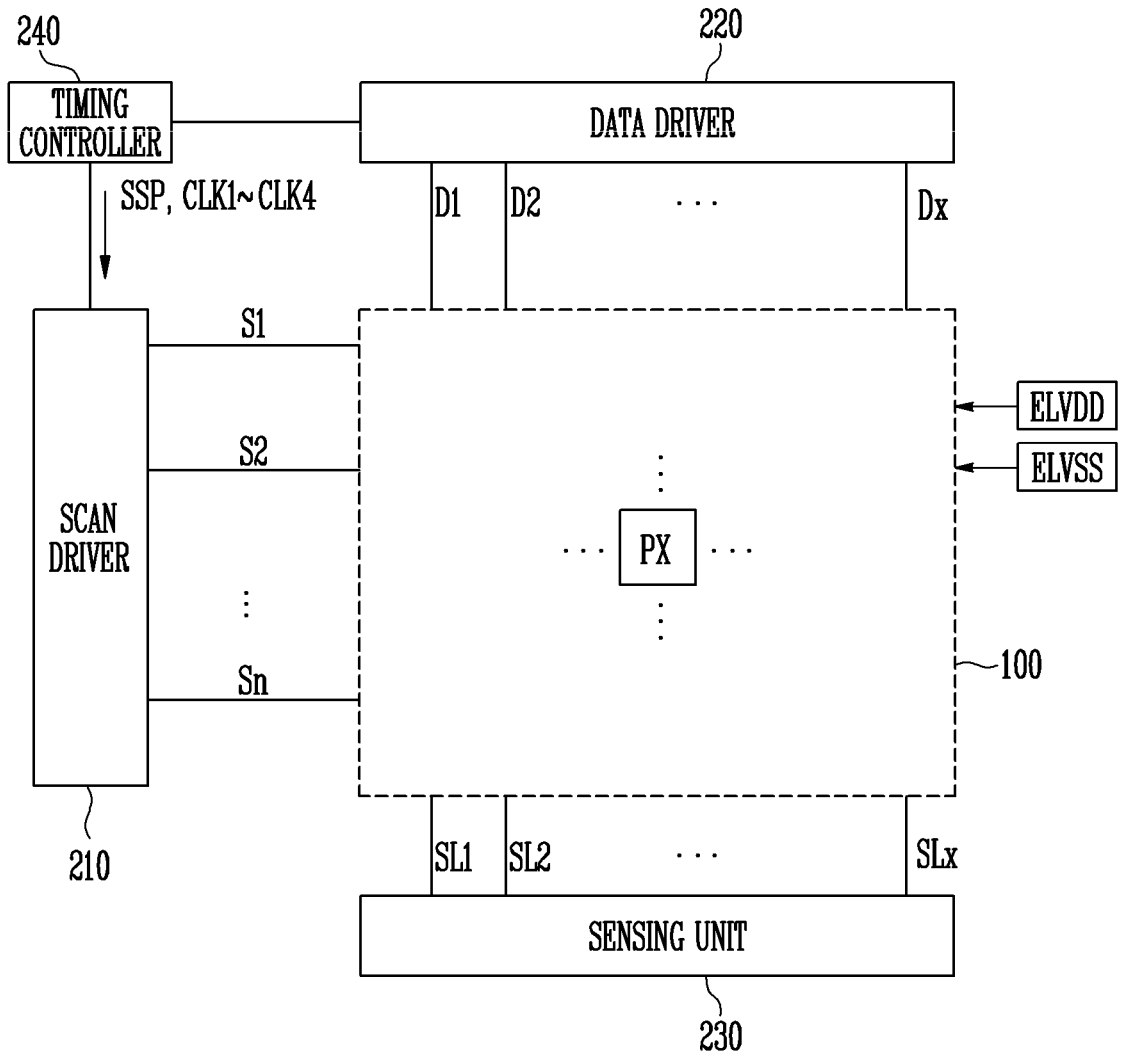
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an exemplary embodiment of a display device constructed according to the principles of the invention.

Referring to FIG. 1, the display device may include a display unit 100 including a plurality of pixels PX, a scan driver 210, a data driver 220, a sensing unit 230, and a timing controller 240.

The timing controller 240 may generate a scan drive control signal and a data drive control signal, based on externally input signals. The scan drive control signal and the data drive control signal generated by the timing controller 240 may be supplied to the scan driver 210 and the data driver 220, respectively.

The scan drive control signal may include a plurality of clock signals and a scan start signal SSP. The scan start signal SSP may control output timing of a first scan signal.

The plurality of clock signals supplied to the scan driver 210 may include first to fourth clock signals CLK1 to CLK4. The first to fourth clock signals CLK1 to CLK4 may be used to shift the scan start signal SSP. In addition, the scan driver 210 may further receive a clock signal other than the first to fourth clock signals CLK1 to CLK4 described above.

The data drive control signal may include a source start pulse and clock signals. The source start pulse may be used to control sampling start time of data, and the clock signals may be used to control a sampling operation.

The scan driver 210 may output scan signals in response to the scan drive control signal. The scan driver 210 may sequentially supply the scan signals to scan lines S1 to Sn. Here, the scan signal may be set to a gate-on voltage (for example, a high-level voltage) such that the transistors included in the pixels PX can be turned on.

The data driver 220 may supply data signals to data lines D1 to Dx in response to the data drive control signal. The data signals may be supplied through the data lines D1 to Dx to the pixels PX to which the scan signals are supplied. To this end, the data driver 220 may supply the data signals to the data lines D1 to Dx so as to be synchronized with the scan signals.

The sensing unit 230 may supply initialization power to the pixels PX through sensing lines SL1 to SLx and measure mobility information and deterioration information of the pixels PX. Although the sensing unit 230 is shown as being a separate structure in FIG. 1, the sensing unit 230 may be included in the data driver 220.

The display unit 100 may include a plurality of the pixels PX connected to the data lines D1 to Dx, the scan lines S1 to Sn, and the sensing lines SL1 to SLx.

The pixels PX may receive first power ELVDD and second power ELVSS from an external source outside the display unit 100.

The pixels PX may receive the data signals respectively through the data lines D1 to Dx when the scan signals are supplied through the scan lines S1 to Sn connected thereto. The pixel receiving the data signal may control the amount of current flowing from the first power supply ELVDD to the second power supply ELVSS via a light emitting element in response to the data signal.

At this time, the light emitting element may generate light of a brightness corresponding to the amount of current. The first power ELVDD may be set to a voltage higher than the second power ELVSS.

Each of the pixels PX may be connected to a light emission control line in addition to the scan lines S1 to Sn and the data lines D1 to Dx in exemplary embodiments, and in this case, a light emission driver for outputting a light emission control signal to the light emission control line may be further included in the display device.

Figure 2:
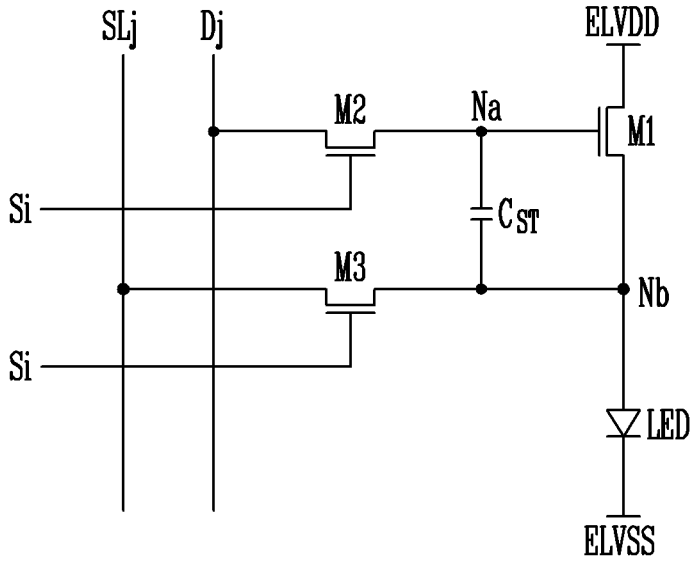
FIG. 2 is a circuit diagram of an exemplary embodiment of a representative one of the pixels of FIG. 1.

FIG. 2 is a circuit diagram of an exemplary embodiment of a representative one of the pixels of FIG. 1. For the sake of convenient description, FIG. 2 illustrates the pixel connected to the i-th scan line S1 and the j-th data line Dj where i is an integer equal to or greater than 1 and equal to or less than n, and j is an integer equal to or greater than 1 and equal to or less than x.

The pixel may include a drive transistor M1, a switching transistor M2, a sensing transistor M3, a storage capacitor $C_{ST}$, and a light emitting element LED.

The switching transistor M2 may have a first terminal connected to the j-th data line Dj, a gate terminal connected to the i th scan line Si, and a second terminal connected to a first node Na.

The switching transistor M2 may be turned on when the scan signal is supplied through the i-th scan line Si to supply the data signal from the j-th data line Dj to the storage capacitor $C_{ST}$. Accordingly, the potential of a first node Na may be controlled.

At this time, the storage capacitor $C_{ST}$ including a first terminal connected to the first node Na and a second terminal connected to a second node Nb may be charged to a voltage corresponding to the data signal.

The drive transistor M1 may have a first terminal connected to the first power supply ELVDD, a second terminal connected to the light emitting element LED, and a gate terminal connected to the first node Na.

The drive transistor M1 may control the amount of current flowing through the light emitting element (LED) in response to a gate-source voltage value, which is a voltage between the first and second terminals of the storage capacitor $C_{ST}$.

The sensing transistor M3 may have a first terminal connected to the j-th sensing line SLj, a second terminal connected to the second node Nb, and a gate terminal connected to the i-th scan line Si. The sensing transistor M3 may be turned on when a scan signal is supplied to the i-th scan line Si to control a potential of the second node Nb. Alternatively, when the scan signal is supplied to the i-th scan line Si, the sensing transistor M3 may be turned on to measure the current flowing through the light emitting element LED to the j-th sensing line SLj.

The light emitting element LED may have a first terminal such as an anode terminal connected to the second terminal of the drive transistor M1 and a second terminal such as a cathode terminal connected to the second power supply ELVSS. The light emitting element LED may generate light corresponding to the amount of current supplied through the drive transistor M1.

In FIG. 2, each of the first terminals of the transistors M1 to M3 may be set as either a source terminal or a drain terminal, and each of the second terminals of the transistors M1 to M3 may be set as the other one of the source terminal or the drain terminal. For example, if the first terminal is set as the source terminal, the second terminal may be set as the drain terminal.

In addition, the transistors M1 to M3 may be NMOS transistors as shown in FIG. 2.

While mobility of the drive transistor M1 is sensed, an activated (or enabled) signal is supplied to the scan line Si. For example, the mobility of the drive transistor M1 may be sensed by the sensing unit 230 of FIG. 1 through the j-th sensing line SLj when the third transistor M3 is turned on in response to the scan signal supplied through the scan line Si.

Figure 3:
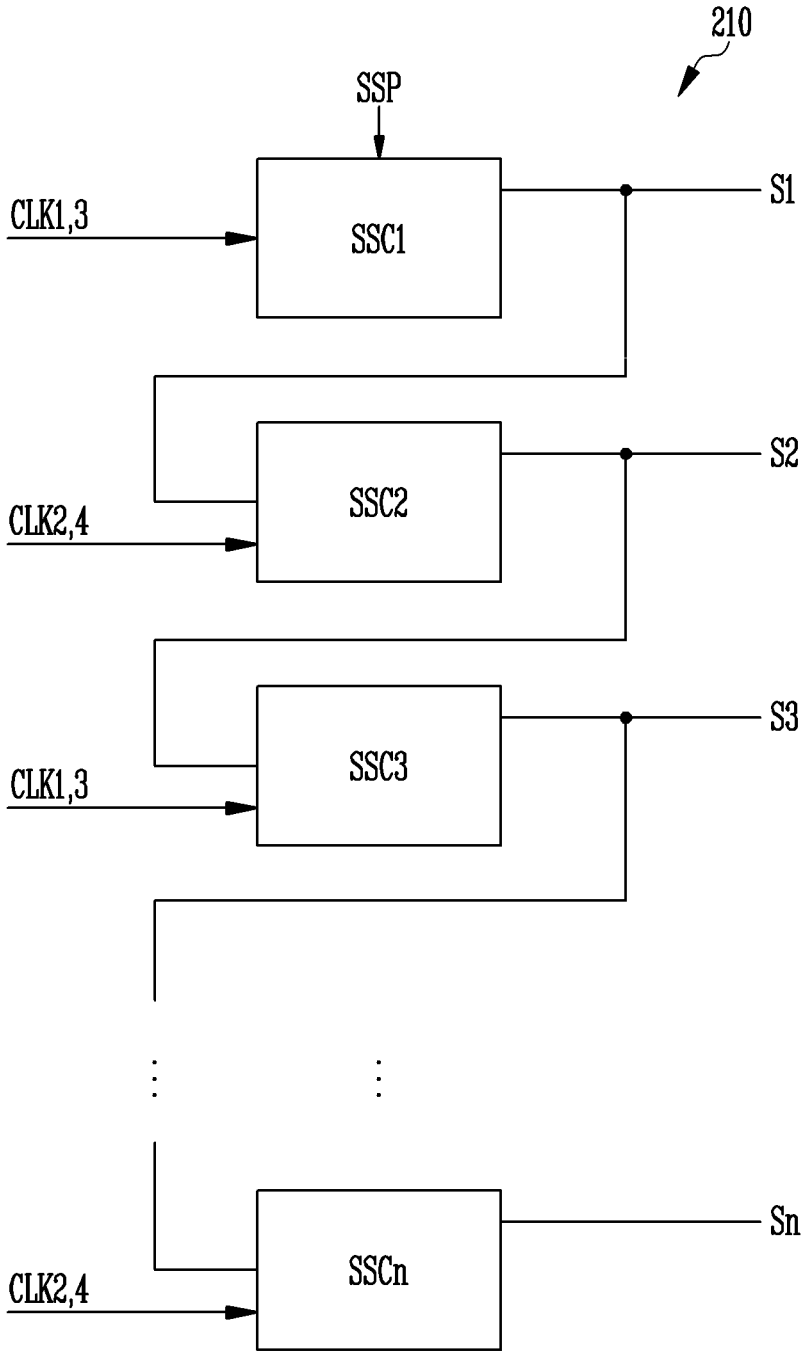
FIG. 3 is a block diagram of an exemplary embodiment of the scan driver of FIG. 1.

FIG. 3 is a block diagram of an exemplary embodiment of the scan driver of FIG. 1.

Referring to FIG. 3, the scan driver 210 may include a plurality of scan signal output circuits SSC1 to SSCn. The scan driver 210 may respectively supply the scan signals to the scan lines S1 to Sn such that a display device can display an image. In addition, the scan driver 210 may supply the scan signals respectively to the scan lines S1 to Sn such that the display device can perform a mobility sensing operation and a threshold voltage sensing operation.

The scan signal output circuits SSC1 to SSCn may be sequentially connected to each other. In an exemplary embodiment, the k-th scan line Sk may be connected to the k−1-th scan signal output circuit SSCk−1 and the k+1-th scan signal output circuit SSCk+1 where k is an integer equal to or greater than 1 and equal to or less than n. Each of the scan signal output circuits SSC1 to SSCn may receive at least two clock signals among the first to fourth clock signals CLK1 to CLK4.

In an exemplary embodiment, the odd-numbered scan signal output circuits receive the first and third clock signals CLK1 and CLK3, and the even-numbered scan signal output circuits receive the second and fourth clock signals CLK2 and CLK4. The first scan signal output circuit SSC1 may receive the first and third clock signals CLK1 and CLK3 and the scan start signal SSP and may be connected to the first scan line S1. The second scan signal output circuit SSC2 may be connected to the first scan signal output circuit SSC1 through the first scan line S1, may receive the scan signal output from the first scan signal output circuit SSC1, and may receive the second and fourth clock signals CLK2 and CLK4. The second scan signal output circuit SSC2 may be connected to the second scan line S2. The n-th scan signal output circuit SSCn may be connected to the n−1-th scan signal output circuit SSCn−1 through the n−1-th scan line Sn−1, may receive the scan signal output from the n−1-th scan signal output circuit SSCn−1, and may receive the second and fourth clock signals CLK2 and CLK4. The n-th scan signal output circuit SSCn may be connected to the n-th scan line Sn.

When the display device performs an operation of displaying an image, the scan driver 210 may sequentially apply the scan signals to the first to n-th scan lines in response to the scan start signal SSP. For example, after the first scan signal output circuit SSC1 outputs a scan signal, the second scan signal output circuit SSC2 may output a scan signal, and after the second scan signal output circuit SSC2 outputs a scan signal, the third scan signal output circuit SSC3 may output a scan signal, and after the n−1-th scan signal output circuit SSCn−1 outputs a scan signal, the n-th scan signal output circuit SSCn may output a scan signal.

For performing the mobility sensing operation, the scan driver 210 may select a scan line connected to pixels to be sensed, and then may output the sensing signal to the selected scan line.

The display device displays an image in the display unit 100 during each frame, and the scan driver 210 may sequentially apply the scan signals to the scan lines S1 to Sn during a display period of the frame in which the image is displayed and apply the scan signal to at least one of the scan lines S1 to Sn during a porch period of the one frame in which the mobility sensing operation is performed.

Figure 4:
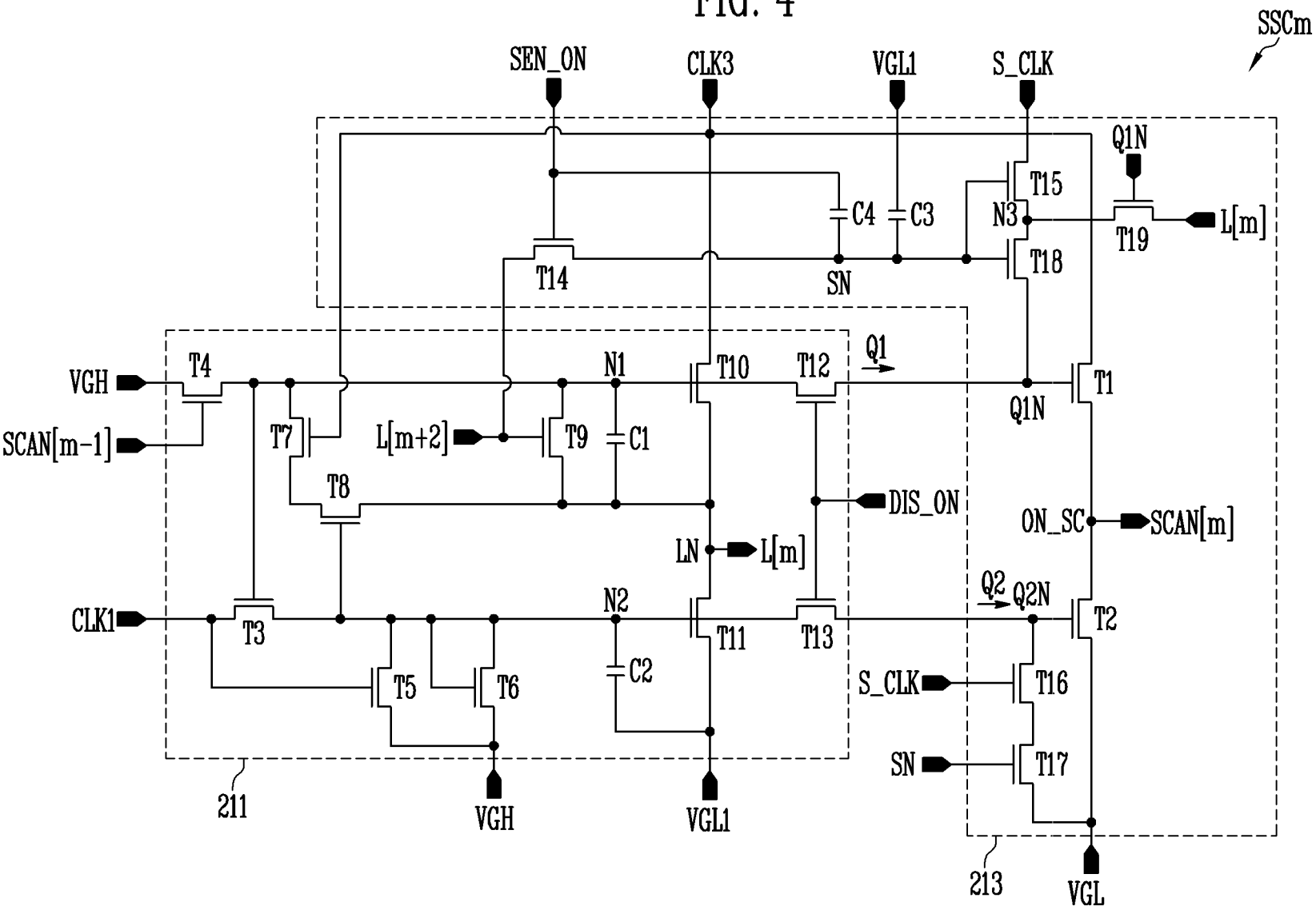
FIG. 4 is a circuit diagram of an exemplary embodiment of any one of the scan signal output circuits of FIG. 3.

FIG. 4 is a circuit diagram of an exemplary embodiment of any one of the scan signal output circuits of FIG. 3. For the sake of convenient description, FIG. 4 illustrates a structure of the m-th scan signal output circuit SSCm.

Referring to FIG. 4, the m-th scan signal output circuit SSCm may include a drive circuit 211 and a buffer circuit 213.

The drive circuit 211 may include third to thirteenth transistors T3 to T13 and first and second capacitors C1 and C2.

The third transistor T3 may have a first terminal for receiving the first clock signal CLK1, a second terminal connected to a second node N2, and a gate terminal connected to a first node N1.

The fourth transistor T4 may have a first terminal connected to an on-level voltage VGH, a second terminal connected to the first node N1, and a gate terminal for receiving the m−1-th scan signal SCAN[m−1]. Although the m−1-th scan signal SCAN[m−1] is shown as being input to the gate terminal of the fourth transistor T4 in FIG. 4, the scan start signal SSP may be input to the gate terminal of the fourth transistor T4 included in the first scan signal output circuit SSC1 as an input signal.

The fifth transistor T5 may have a first terminal connected to the second node N2, a second terminal connected to the on-level voltage VGH, and a gate terminal for receiving the first clock signal CLK1.

The sixth transistor T6 may have a first terminal connected to the second node N2, a second terminal connected to the on-level voltage VGH, and a gate terminal connected to the second node N2.

The seventh transistor T7 may have a first terminal connected to the first node N1, a second terminal connected to a first terminal of the eighth transistor T8, and a gate terminal for receiving the third clock signal CLK3.

The eighth transistor T8 may have the first terminal connected to the second terminal of the seventh transistor T7, a second terminal connected to a connection signal output node LN, and a gate terminal connected to the second node N2.

The ninth transistor T9 may have a first terminal connected to the first node N1, a second terminal connected to the connection signal output node LN, and a gate terminal for receiving a subsequent connection signal L[m+2]. Although the subsequent connection signal L[m+2] is illustrated as a connection signal output from the m+2-th scan signal output circuit SSCm+2, the subsequent connection signal L[m+2]) may be a connection signal output from another scan signal output circuit depending on an exemplary embodiment.

The first capacitor C1 may have a first terminal connected to the first node N1 and a second terminal connected to the connection signal output node LN.

The tenth transistor T10 may have a first terminal for receiving the third clock signal CLK3, a second terminal connected to the connection signal output node LN, and a gate terminal connected to the first node N1.

The eleventh transistor T11 may have a first terminal connected to the connection signal output node LN, a second terminal for receiving an auxiliary off-level voltage VGL1 lower than an off-level voltage VGL, and a gate terminal connected to the second node N2. The off-level voltage VGL may be lower than the on-level voltage VGH.

The second capacitor C2 may have a first terminal connected to the second node N2 and a second terminal for receiving the auxiliary off-level voltage VGL1.

The twelfth transistor T12 may have a first terminal connected to the first node N1, a second terminal connected to a first drive node Q1N, and a gate terminal for receiving a display-on signal DIS_ON.

The thirteenth transistor T13 may have a first terminal connected to the second node N2, a second terminal connected to a second drive node Q2N, and a gate terminal for receiving the display-on signal DIS_ON.

Next, the buffer circuit 213 may include a first transistor T1, a second transistor T2, fourteenth to nineteen transistors T14 to T19, a third capacitor C3, and a fourth capacitor C4.

The fourteenth transistor T14 may have a first terminal for receiving the subsequent connection signal L[m+2], a second terminal connected to a sampling node SN, and a gate terminal for receiving a sensing-on signal SEN_ON.

The third capacitor C3 may have a first terminal connected to the sampling node SN and a second terminal connected to the auxiliary off-level voltage VGL1. According to an exemplary embodiment, the second terminal of the third capacitor C3 may be connected to the off-level voltage VGL.

The fourth capacitor C4 may have a first terminal connected to the sampling node SN and a second terminal for receiving the sensing-on signal SEN_ON.

The fifteenth transistor T15 may have a first terminal for receiving a sensing mode activation clock signal S_CLK, a second terminal connected to a third node N3, and a gate terminal connected to the sampling node SN.

The sixteenth transistor T16 may have a first terminal connected to the second drive node Q2N, a second terminal connected to a first terminal of the seventeenth transistor T17, and a gate terminal for receiving the sensing mode activation clock signal S_CLK.

The seventeenth transistor T17 may have the first terminal connected to the second terminal of the sixteenth transistor T16, a second terminal connected to the off-level voltage VGL, and a gate terminal connected to the sampling node SN.

The eighteenth transistor T18 may have a first terminal connected to the third node N3, that is, the second terminal of the fifteenth transistor T15, a second terminal connected to the first drive node Q1N, and a gate terminal connected to the sampling node SN.

The nineteenth transistor T19 may have a first terminal connected to the third node N3, a second terminal for receiving the connection signal L[m] of the connection signal output node LN, and a gate terminal connected to the first drive node Q1N.

The first transistor T1 may have a first terminal for receiving the third clock signal CLK3, a second terminal connected to a scan signal output node ON_SC, and a gate terminal connected to the first drive node Q1N.

The second transistor T2 may have a first terminal connected to the scan signal output node ON_SC, a second terminal for receiving the off-level voltage VGL, and a gate terminal connected to the second drive node Q2N.

Control signals such as the display-on signal DIS_ON, the sensing-on signal SEN_ON, and the sensing mode activation clock signal S_CLK may be provided by the timing controller 240 of FIG. 1.

In an exemplary embodiment, the buffer circuit 213 may further include a capacitor having a first terminal connected to the first drive node Q1N and a second terminal connected to the scan signal output node ON_SC.

In an exemplary embodiment, the buffer circuit 213 may further include a capacitor having a first terminal connected to the second drive node Q2N and a second terminal connected to the off-level voltage VGL.

Each of the scan signal output circuits SSC1 to SSCn may receive a plurality of clock signals and output the scan signal to the scan signal output node ON_SC based on the received clock signals.

For example, the m-th scan signal output circuit SSCm may receive the first clock signal CLK1 and the third clock signal CLK3 and output a scan signal SCAN[m] based on the first and third clock signals CLK1 and CLK3.

In this manner, a rising edge of the third clock signal CLK3 may be adjacent to a falling edge of the first clock signal CLK1, a rising edge of the first clock signal CLK1 may be adjacent to a falling edge of the third clock signal CLK3, and an activation period of the first clock signal CLK1 may not overlap an activation period of the third clock signal CLK3.

When the display device is in a display mode, one frame may include the display period and the porch period. During the display period, the display-on signal DIS_ON may be activated and the sensing mode activation clock signal S_CLK may be deactivated. During the porch period, the sensing mode activation clock signal S_CLK may be activated when the display-on signal DIS_ON is deactivated (or disabled).

Furthermore, when the subsequent connection signal L[m+2] is activated in the display period, the sensing-on signal SEN_ON may be activated or deactivated. For example, if the sensing-on signal SEN_ON is activated when the subsequent connection signal L[m+2] is activated in the display period, the activated subsequent connection signal L[m+2] may be transferred to the sampling node SN through the fourteenth transistor T14 such that a sampling voltage may be stored in the sampling node SN of the m-th scan signal output circuit SSCm. If the sensing-on signal SEN_ON is not activated when the subsequent connection signal L[m+2] is activated in the display period, the fourteenth transistor T14 may be turned off and the sampling voltage may not be stored in the sampling node SN of the m-th scan signal output circuit SSCm.

Figure 5:
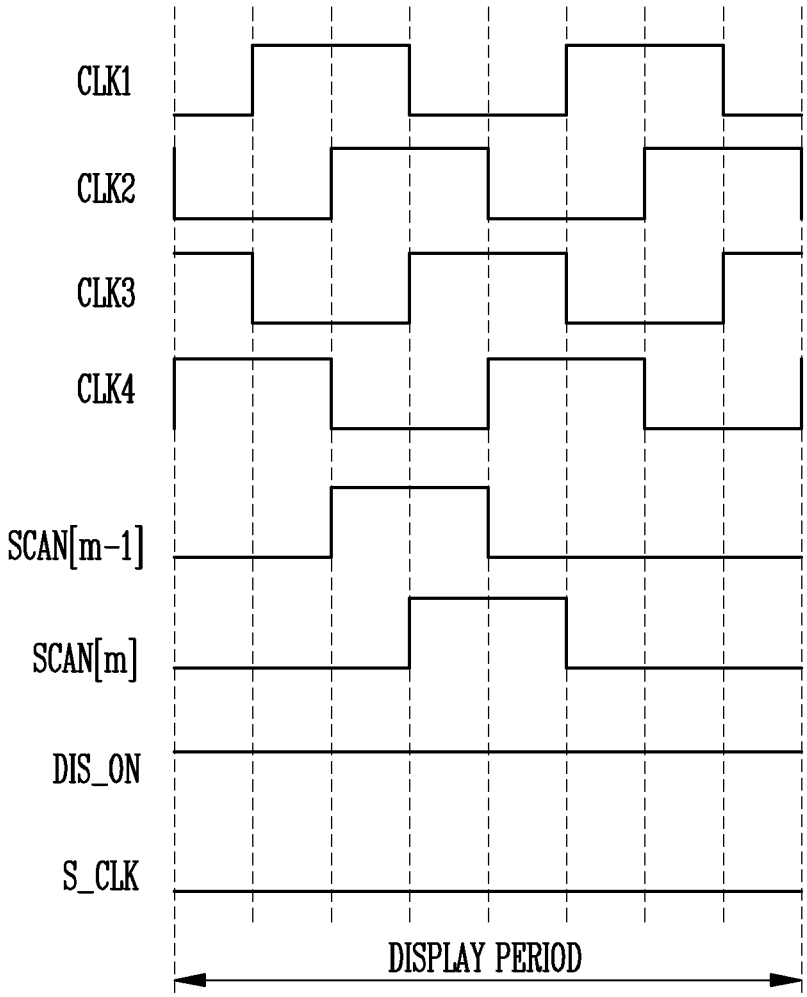
FIG. 5 is a timing diagram illustrating some of signals of the scan signal output circuit of FIG. 4 in association with generation of a scan signal in a display period.

FIG. 5 is a timing diagram illustrating some of signals of the scan signal output circuit of FIG. 4 in association with generation of a scan signal in a display period.

Although the first to fourth clock signals CLK1 to CLK4 are illustrated in FIG. 5, it is assumed that the m-th scan signal output circuit SSCm receives the first clock signal CLK1 and the third clock signal CLK3. In this case, the m+1-th scan signal output circuit SSCm+1 may receive the second clock signal CLK2 and the fourth clock signal CLK4.

Referring to FIG. 5, during the display period of the frame, the sensing mode activation clock signal S_CLK may be kept inactive (e.g., a logic low level), and the display-on signal DIS_ON may be kept active (e.g., a logic high level).

When the m−1-th scan signal SCAN[m−1] is input and the fourth transistor T4 is turned on, the first node N1 and the first drive node Q1N are charged with the on-level voltage VGH, and thereby, a signal applied to the first node N1 and a first drive signal Q1 applied to the first drive node Q1N may have the on-level voltage VGH.

When the m−1-th scan signal SCAN[m−1] is input and the fourth transistor T4 is turned on, the second node N2 and the second drive Q2N is charged with an inactive voltage of the first clock signal CLK1 since the third transistor T3 is turned on by the signal of the first node N1 having the on-level voltage VGH, and, thereby, a signal applied to the second node N2 and a second drive signal Q2 applied to the second drive node Q2N may have the inactive voltage of the first clock signal CLK1.

Accordingly, as the third clock signal CLK3 is activated, the scan signal SCAN[m] having the active voltage of the third clock signal CLK3, such as a scan-on signal, may be output through the scan signal output node ON_SC.

The tenth transistor T10 may be turned on and the eleventh transistor T11 may be turned off due to the first drive signal Q1 having the on-level voltage VGH and the second drive signal Q2 having the inactive voltage of the first clock signal CLK1. As the third clock signal CLK3 is activated, the connection signal L[m] having the active voltage of the third clock signal CLK3 may be output through the connection node LN.

When the first drive node Q1N is charged with the on-level voltage VGH, the nineteenth transistor T19 is turned on, and thereby, the third node N3 may be charged with the connection signal L[m] having the active voltage of the third clock signal CLK3.

That is, a drain-source voltage (i.e., a voltage between the first terminal and the second terminal) of the eighteenth transistor T18 may be a voltage difference between the on-level voltage VGH charged in the first drive node Q1N and a voltage of the connection signal L[m] having the active voltage of the third clock signal CLK3. In addition, a drain-source voltage of the fifteenth transistor T15 may be a voltage difference between the connection signal L[m] having the active voltage of the third clock signal CLK3 and a voltage of the sensing mode activation clock signal S_CLK that is deactivated.

For example, when the on-level voltage VGH charged in the first drive node Q1N is approximately 54 V, a voltage of the connection signal L[m] having the active voltage of the third clock signal CLK3 is approximately 25 V, and the inactive sensing mode activation clock signal S_CLK is approximately −12 V, a drain-source voltage of the eighteenth transistor T18 may be approximately 29 V and a drain-source voltage of the fifteenth transistor T15 is approximately 37 V.

Unlike the scan signal output circuit according to the illustrated embodiment, if the scan signal output circuit does not include the eighteenth transistor T18 and the nineteenth transistor T19, when the first drive node Q1N is charged with the on-level voltage VGH and the sensing mode activation clock signal S_CLK is deactivated, a very high voltage is applied between the drain and the source of the fifteenth transistor T15. In this manner, a high voltage stress is continuously applied to the fifteenth transistor T15.

Whereas, when the eighteenth transistor T18 is connected between the fifteenth transistor T15 and the first drive node Q1N and the nineteenth transistor T19 transfers the connection signal L[m] to the third node N3 connected between the fifteenth transistor T15 and the first drive node Q1N may reduce the high voltage stress applied to the fifteenth transistor T15, as in the illustrated embodiment.

Thereafter, the third clock signal CLK3 is deactivated again, and thereby, the scan signal SCAN[m] having an inactive voltage of the third clock signal CLK3, such as a scan-off signal, may be output through the scan signal output node ON_SC. Also, the connection signal L[m] may have the inactive voltage of the third clock signal CLK3.

In addition, as the third clock signal CLK3 is deactivated again, the connection signal L[m] having the inactive voltage of the third clock signal CLK3 may be output through the connection node LN.

In this manner, the scan signal output circuits SSC1 to SSCn sequentially connected to each other may sequentially output the scan signals having the activation voltage during a display period of one frame of the display device.

Figure 6:
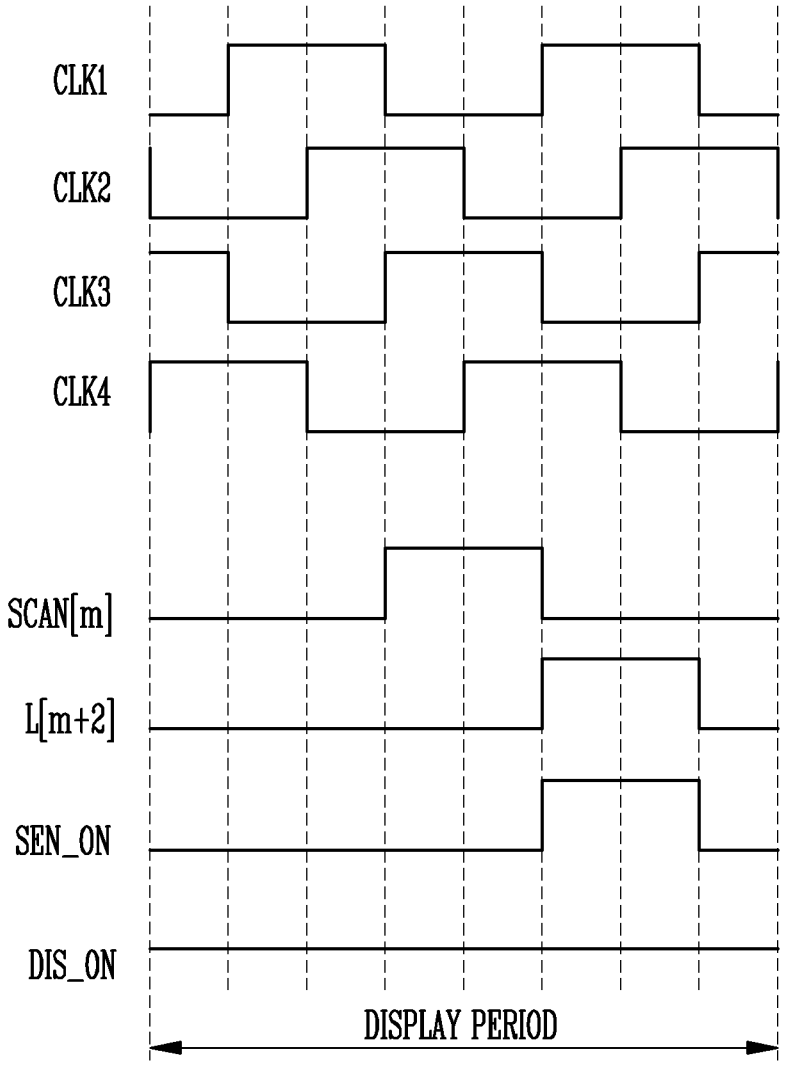
FIG. 6 is a timing diagram illustrating some of signals of the scan signal output circuit of FIG. 4 in association with selection of a scan line for sensing pixels in a display period.

FIG. 6 is a timing diagram illustrating some of signals of the scan signal output circuit of FIG. 4 in association with selection of a scan line for sensing pixels in a display period.

Referring to FIG. 6, when the first clock signal CLK1 is first activated, the on-level voltage VGH is supplied to the second node N2 through the fifth transistor T5 and the second node N2 is charged with the on-level voltage VGH, and thereby, the eleventh transistor T11 is turned on. At this time, when the subsequent connection signal L[m+2] is activated, the auxiliary off-level voltage VGL1 is supplied to the first node N1 and the drive node Q1N through the eleventh transistor T11 and the ninth transistor T9 to reset the first node N1 and the drive node Q1N. The drive node Q1N may have the auxiliary off-level voltage VGL1 since the display-on signal DIS_ON is activated during the display period and the auxiliary off-level voltage VGL1 is transferred to the drive node Q1N through the twelfth transistor 12 which is turned on.

As the sensing-on signal SEN_ON is activated in a state where the subsequent connection signal L[m+2] is activated, the fourteenth transistor T14 is turned on, and thereby, the sampling node SN may be charged with an active voltage of the subsequent connection signal L[m+2]. As a result, the sampling node SN may store and maintain a sampling voltage using the third capacitor C3.

In an exemplary embodiment, the sensing-on signal SEN_ON may be activated for all of the scan signal output circuits SSC1 to SSCn.

Although the subsequent connection signal L[m+2] is illustrated as a connection signal output from the m+2-th scan signal output circuit SSCm+2, the subsequent connection signal may be a connection signal output from another scan signal output circuit depending on an exemplary embodiment.

Figure 7:
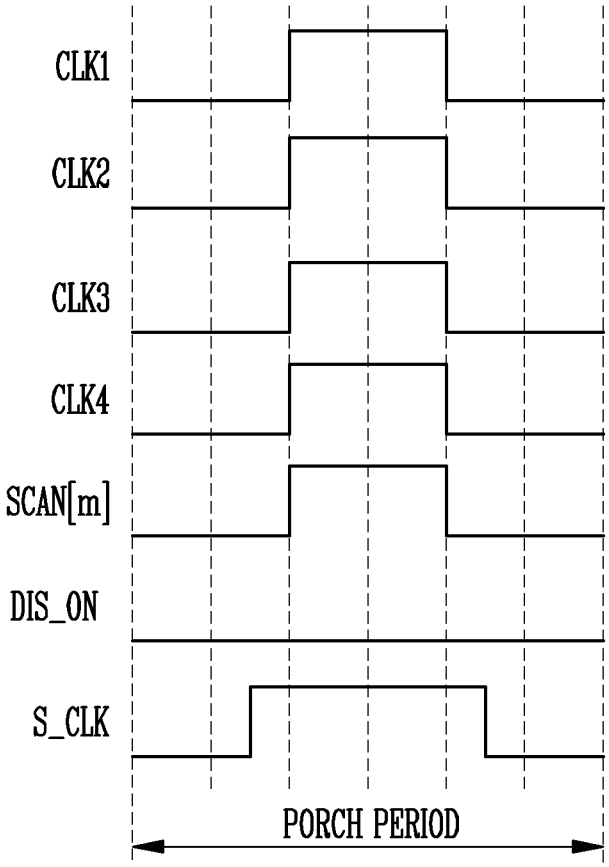
FIG. 7 is a timing diagram illustrating some of signals of the scan signal output circuit of FIG. 4 in a porch period.

FIG. 7 is a timing diagram illustrating some of signals of the scan signal output circuit of FIG. 4 in a porch period.

Referring to FIG. 7, the fifteenth transistor T15 and the eighteenth transistor T18 in the scan signal output circuit SSCm in which the sampling node SN maintains the sampling voltage using the third capacitor C3 may be turned on by the sampling voltage. The twelfth and thirteenth transistors T12 and T13 may be turned off in response to the display-on signal DIS_ON deactivated in the porch period, and therefore the first and second drive nodes Q1N and Q2N may be disconnected from the first and second nodes N1 and N2, respectively.

When the sensing mode activation clock signal S_CLK is activated in the porch period of one frame in a state where the fifteenth transistor T15 and the eighteenth transistor T18 are turned on, the first drive node Q1N may be charged with an active voltage of the sensing mode activation clock signal S_CLK.

Accordingly, the first drive signal Q1 applied to the first drive node Q1N may have the active voltage of the sensing mode activation clock signal S_CLK. As a result, the first transistor T1 may be turned on, and the scan signal SCAN [m] having the active voltage of the third clock signal CLK3, such as a sense-on signal, may output through the scan signal output node ON_SC. At this time, the remaining clock signals CLK1, CLK2, and CLK4 except for the third clock signal CLK3 may have inactive voltages, but exemplary embodiments are not limited thereto, and the remaining clock signals CLK1, CLK2, and CL4 may also have inactive voltages.

During the porch period of one frame, the fifteenth transistor T15 and the eighteenth transistor T18 in the scan signal output circuits SSC1 to SSCm−1 and SSCm+1 to SSCn which do not store the sampling voltage are not turned on, thereby, being unable to output the sensing-on signal having the active voltage of the third clock signal CLK3 to the scan signal output node ON_SC.

According to some exemplary embodiments, a scan signal may be output to a scan line for sensing pixels connected to the scan line by selecting the scan line in the display period and by applying the scan signal to the selected scan line in the porch period. Therefore, only a relatively short time may be required to sense the pixels.

Figure 8:
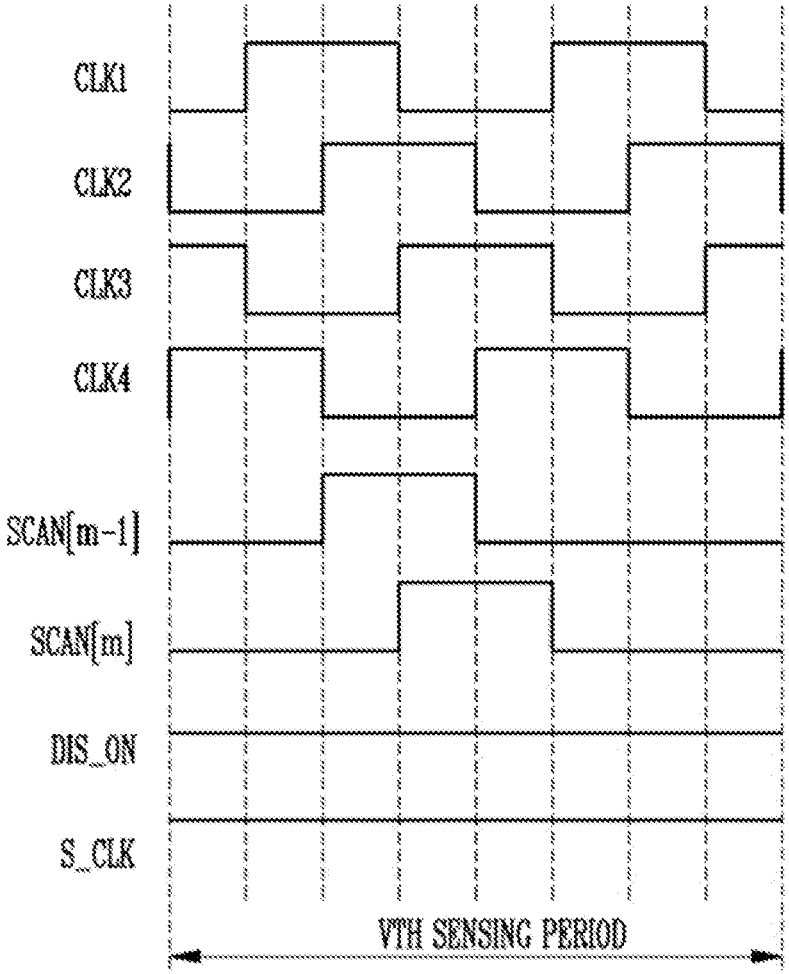
FIG. 8 is a timing diagram illustrating some of signals of the scan signal output circuit of FIG. 4 in a threshold voltage sensing period.

FIG. 8 is a timing diagram illustrating some of signals of the scan signal output circuit of FIG. 4 in a threshold voltage sensing period.

Referring to FIG. 8, when the display device is in a non-display mode, one frame for sensing or scanning the pixels PX of the display unit 100 includes a threshold voltage sensing period (VTH sensing period), and the display device may perform the threshold voltage sensing operation during the threshold voltage sensing period (VTH sensing period).

During the threshold voltage sensing period (VTH sensing period) of the frame, the first to n-th scan signal output circuits SSC1 to SSCn may sequentially apply the scan-on signals to the first to n-th scan lines in the same manner as in the display period.

At this time, the threshold voltage sensing period (VTH sensing period) may be longer than the display period, which may be achieved by adjusting pulse widths of the first to fourth clock signals CLK1 to CLK4.

During the threshold voltage sensing period (VTH sensing period) of the frame of the display device, the sensing mode activation clock signal S_CLK may be kept active and the display-on signal DIS_ON may be kept active.

At this time, when the m−1-th scan signal SCAN[m−1] is activated and the fourth transistor T4 is turned on, the first node N1 and the first drive node Q1N are charged with the on-level voltage VGH, and thereby, a signal applied to the first node N1 and a signal applied to the first drive node Q1N may have the on-level voltage VGH.

When the first clock signal CLK1 is deactivated in the case where the m−1-th scan signal SCAN[m−1] is activated and the fourth transistor T4 is turned on, the second node N2 and the second drive node Q2N are discharged with an inactive voltage of the first clock signal CLK1 by the deactivated first clock signal CLK1, and thereby, a signal applied to the second node N2 and the second drive signal Q2 applied to the second drive node Q2N may have the inactive voltage of the first clock signal CLK1.

As a result, the first transistor T1 and the tenth transistor T10 may be turned on, and the second transistor T2 and the eleventh transistor T11 may be turned off.

Accordingly, as the third clock signal CLK3 is activated, the scan signal SCAN[m] having an active voltage of the third clock signal CLK3, such as the scan-on signal, may be output through the scan signal output node ON_SC, and the connection signal L[m] having the active voltage of the third clock signal CLK3 may be output through the connection node LN.

Thereafter, as the third clock signal CLK3 is deactivated again, the scan signal SCAN[m] having the inactive voltage of the third clock signal CLK3, such as the scan-off signal, may be output through the scan signal output node ON_SC, and the connection signal L[m] having the inactive voltage of the third clock signal CLK3 may be output through the connection node LN.

Since the display-on signal DIS_ON is kept active, the scan signal SCAN[m] and the connection signal L[m] may have substantially the same waveform.

In this manner, the scan signal output circuits SSC1 to SSCn connected to each other in the scan driver 210 may sequentially output the scan signals, with each having the active voltage of the third clock signal CLK3 such as the scan-on signal during the threshold voltage sensing period (VTH sensing period) of the frame of the display device.

Figure 9:
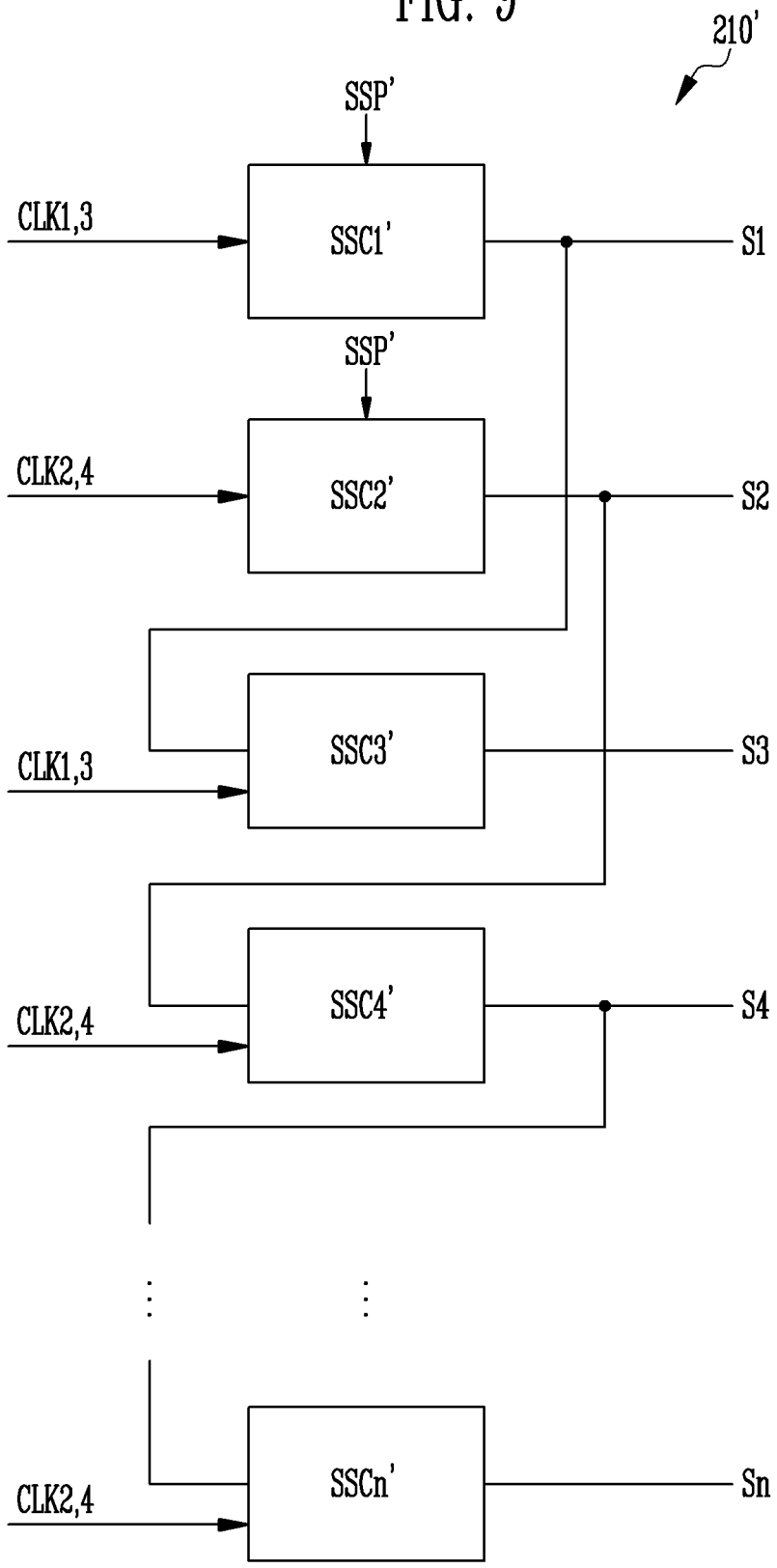
FIG. 9 is a block diagram of another exemplary embodiment of the scan driver of FIG. 1.

FIG. 9 is a block diagram of another exemplary embodiment of the scan driver of FIG. 1. In FIG. 9, description will be focused on modified portions in comparison with the above-described exemplary embodiments, and the overlapping description will be omitted to avoid redundancy. Accordingly, description will be focused on the connection relationship between scan signal output circuits SSC1' to SSCn'.

Referring to FIG. 9, a scan driver 210' may include a plurality of scan signal output circuits SSC1' to SSCn' connected to first to n-th scan lines S1 to Sn. At least two or more of the scan signal output circuits SSC1' to SSCn' may be connected to each other. In an exemplary embodiment, the scan signal output circuits SSC1' to SSCn' may be divided into two groups, and the scan signal output circuits of each group may be sequentially connected to each other.

For example, the first scan signal output circuit SSC1' receives a scan start signal SSP' and may be connected to the first scan line S1. The second scan signal output circuit SSC2' receives the scan start signal SSP' and may be connected to the second scan line S2. The third scan signal output circuit SSC3' may be connected to the first scan signal output circuit SSC1' through the first scan line S1 to receive a scan signal output from the first scan signal output circuit SSC1' and may be connected to the third scan line S3. The fourth scan signal output circuit SSC4' may be connected to the second scan signal output circuit SSC2' through the second scan line S2 to receive a scan signal output from the second scan signal output circuit SSC2' and may be connected to the fourth scan line S4. The n-th scan signal output circuit SSCn' may be connected to the n−2-th scan signal output circuit SSCn−2' through an n−2-th scan line Sn−2 to receive a scan signal output from the n−2-th scan signal output circuit SSCn−2' and may be connected to the n-th scan line Sn.

Figure 10:
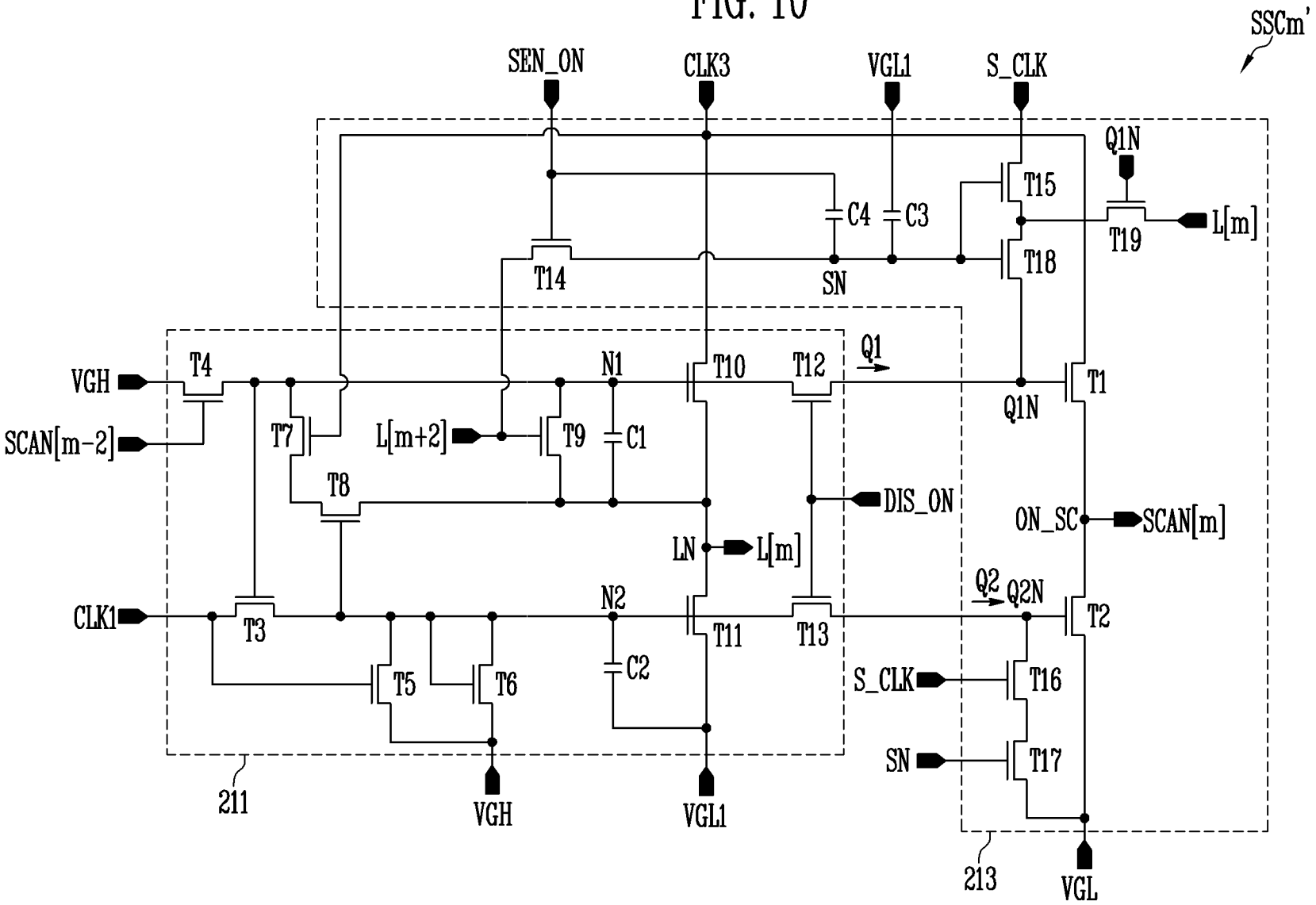
FIG. 10 is a circuit diagram of an exemplary embodiment of any one of the scan signal output circuits of FIG. 9.

FIG. 10 is a circuit diagram of an exemplary embodiment of any one of the scan signal output circuits of FIG. 9. In FIG. 10, a configuration of the m-th scan signal output circuit SSCm' for the sake of convenient description.

In FIG. 10, description will be focused on modified portions in comparison with the above-described exemplary embodiment, and the overlapping description will be omitted.

Referring to FIG. 10, the fourth transistor T4 included in the drive circuit 211 may have a first terminal for receiving the on-level voltage VGH, a second terminal connected to the first node N1, and a gate terminal for receiving the m−2-th scan signal SCAN[m−2].

When the m−2-th scan signal SCAN[m−2] is input to the gate terminal of the fourth transistor T4, a pre-charging period of the first drive node Q1N may increase during a process of generating a scan signal for a display operation in comparison with when the m−1-th scan signal SCAN[m−1] is input to the gate terminal of the fourth transistor T4.

Figure 11:
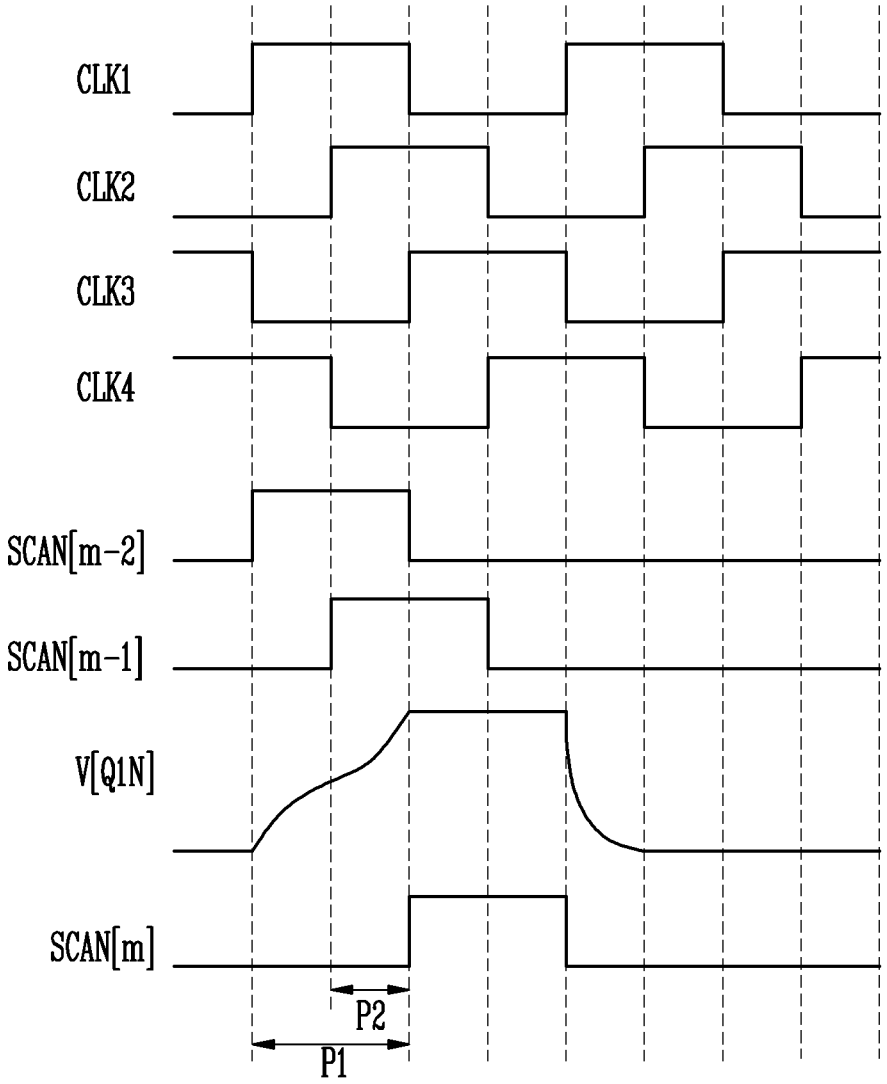
FIG. 11 is a timing diagram illustrating some of signals of the scan signal output circuit of FIG. 10 in association with generation of a scan signal.

FIG. 11 is a timing diagram illustrating some of signals of the scan signal output circuit of FIG. 10 in association with generation of a scan signal.

As described above, when an activated signal of the m−2-th scan signal SCAN[m−2] is input to the gate terminal of the fourth transistor T4, the first drive node Q1N starts to be charged with the on-level voltage VGH.

Accordingly, as illustrated in FIG. 11, when the m−−2-th scan signal SCAN[m−2] is input to the gate terminal of the fourth transistor T4, the first drive node Q1N may be precharged during a first period P1 and a voltage V[Q1N] of the first drive node Q1N may increase relatively high.

Unlike this, if the m−1-th scan signal SCAN[m−1] is input to the gate terminal of the fourth transistor T4, the first drive node Q1N may be precharged during a second period P2 shorter than the first period P1. That is, in a case of the scan driver according to the exemplary embodiment, it is possible to output a more accurate scan signal by precharging the first drive node Q1N in response to the m−2-th scan signal SCAN[m−2] to increase a precharging period of the first drive node Q1N.

As described with reference to FIGS. 9 to 11, according to the exemplary embodiment, not only the first scan signal output circuit SSC1 but also the second scan signal output circuit SSC2 receive the scan start signal SSP' as input signals. Here, a period during which the scan start signal SSP' is activated may be set to be longer than a period from a point of time (corresponding to a rising edge of the first clock signal CLK1) when the first clock signal CLK1 starts to be activated to a point of time (corresponding to a falling edge of the second clock signal CLK2) when the second clock signal CLK2 starts to be deactivated. Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A scan driver for a display device comprising:

first to n-th (where n is a natural number greater than or equal to 2) scan signal output circuits to apply scan signals to scan lines, respectively, the scan lines being connected to pixels operable to display an image during a frame and the first to n-th scan signal output circuits being connected to each other through the scan lines, wherein each of the first to n-th scan signal output circuits includes:

a drive circuit to apply a first drive signal to a first drive node, to apply a second drive signal to a second drive node, and to apply a connection signal to a connection signal output node based on i) an input signal which is one of either a scan start signal or a scan signal applied by another scan signal output circuit, ii) a clock signal, and iii) an on-level voltage; and a buffer circuit to receive the connection signal, the first drive signal, and the second drive signal from the drive circuit, and to output one of the scan signals to one of the scan lines based on the first drive signal, the second drive signal, and the clock signal, wherein:

the frame has a display period and a porch period after the display period;

the first to n-th scan signal output circuits are operable to output the scan signals through respective scan lines during the display period to allow the pixels to display the image; and the buffer circuit is operable to:

select one of the scan lines by charging a sampling node in response to a control signal enabled in the display period; and output the one scan signal to the selected scan line in response to a voltage of the sampling node in the porch period.

2. The scan driver of claim 1, wherein the buffer circuit is operable to select the one scan line for mobility sensing by storing a sampling voltage at the sampling node based on the control signal including a sensing-on signal.

3. The scan driver of claim 1, wherein:

the buffer circuit is operable to select the one scan line by transferring the connection signal of another one of the first to n-th scan signal output circuits to the sampling node to charge the sampling node in response to the control signal.

4. A scan driver for a display device comprising:

first to n-th (where n is a natural number greater than or equal to 2) scan signal output circuits to apply scan signals to scan lines, respectively, the first to n-th scan signal output circuits being connected to each other through the scan lines, wherein each of the first to n-th scan signal output circuits includes:

a drive circuit to apply a first drive signal to a first drive node, to apply a second drive signal to a second drive node, and to apply a connection signal to a connection signal output node based on i) an input signal which is one of either a scan start signal or a scan signal applied by another scan signal output circuit, ii) a clock signal, and iii) an on-level voltage; and a buffer circuit to receive the connection signal, the first drive signal, and the second drive signal from the drive circuit, and to output one of the scan signals to one of the scan lines based on the first drive signal, the second drive signal, and the clock signal, wherein the clock signal includes a first clock signal, a second clock signal, a third clock signal, and a fourth clock signal, and wherein each of the first to n-th scan signal output circuits receives at least two of the first to fourth clock signals.

5. The scan driver of claim 4, wherein the drive circuit included in the m-th (where m is a natural number smaller than n) scan signal output circuit to receive the first clock signal and the third clock signal comprises:

a third transistor having a first terminal for receiving the first clock signal, a second terminal connected to a second node, and a gate terminal connected to a first node;

a fourth transistor having a first terminal that to receive the on-level voltage, a second terminal connected to the first node, and a gate terminal to receive the input signal;

a fifth transistor having a first terminal connected to the second node, a second terminal to receive the on-level voltage, and a gate terminal to receive the first clock signal;

a sixth transistor having a first terminal connected to the second node, a second terminal to receive the on-level voltage, and a gate terminal connected to the second node;

a seventh transistor having a first terminal connected to the first node, a second terminal, and a gate terminal to receive the third clock signal;

an eighth transistor having a first terminal connected to the second terminal of the seventh transistor, a second terminal connected to the connection signal output node, and a gate terminal connected to the second node;

a ninth transistor having a first terminal connected to the first node, a second terminal connected to the connection signal output node, and a gate terminal to receive the connection signal of another one of the first to n-th scan signal output circuits;

a first capacitor having a first terminal connected to the first node and a second terminal connected to the connection signal output node;

a tenth transistor having a first terminal to receive the third clock signal, a second terminal connected to the connection signal output node, and a gate terminal connected to the first node;

an eleventh transistor having a first terminal connected to the connection signal output node, a second terminal to receive an auxiliary off-level voltage, and a gate terminal connected to the second node;

a second capacitor having a first terminal connected to the second node and a second terminal to receive the auxiliary off-level voltage;

a twelfth transistor having a first terminal connected to the first node, a second terminal connected to the first drive node, and a gate terminal to receive the display-on signal; and a thirteenth transistor having a first terminal connected to the second node, a second terminal connected to the second drive node, and a gate terminal to receive the display-on signal.

6. The scan driver of claim 5, wherein the fourth transistor included in the first scan signal output circuit receives the scan start signal as the input signal, and wherein the fourth transistors that are included in the second to n-th scan signal output circuits are operable to receive scan signals applied by the first to n−1-th scan signal output circuits, respectively, as the input signal.

7. The scan driver of claim 5, wherein the fourth transistor included in the first and second scan signal output circuits is operable to receive the scan start signal as the input signal, and wherein the fourth transistor included in the i-th (where i is a natural number greater than or equal to 3 and smaller than or equal to n) scan signal output circuit is operable to receive a scan signal applied by the i−2-th scan signal output circuit as the input signal.

8. The scan driver of claim 5, wherein the buffer circuit included in the m-th scan signal output circuit comprises:

a fourteenth transistor having a first terminal to receive the connection signal of the another one of the first to n-th scan signal output circuits, a second terminal connected to a sampling node, and a gate terminal to receive a sensing-on signal;

a third capacitor having a first terminal connected to the sampling node and a second terminal connected to the auxiliary off-level voltage;

a fourth capacitor having a first terminal connected to the sampling node and a second terminal to receive the sensing-on signal;

a fifteenth transistor having a first terminal to receive a sensing mode activation clock signal, a second terminal connected to a third node, and a gate terminal connected to the sampling node;

a sixteenth transistor having a first terminal connected to the second drive node, a second terminal, and a gate terminal to receive the sensing mode activation clock signal;

a seventeenth transistor having a first terminal connected to the second terminal of the sixteenth transistor, a second terminal connected to an off-level voltage higher than the auxiliary off-level voltage, and a gate terminal connected to the sampling node;

an eighteenth transistor having a first terminal connected to the third node, a second terminal connected to the first drive node, and a gate terminal connected to the sampling node;

a nineteenth transistor having a first terminal connected to the third node, a second terminal connected to the connection signal output node, and a gate terminal connected to the first drive node;

a first transistor having a first terminal to receive a third clock signal, a second terminal to output one of the scan signals, and a gate terminal connected the first drive node; and a second transistor having a first terminal to output one of the scan signals, a second terminal connected to the off-level voltage, and a gate terminal connected to the second drive node.

9. The scan driver of claim 5, wherein the m+1-th scan signal output circuit is operable to receive the second clock signal and the fourth clock signal.

10. A display device comprising:

a display unit including a plurality of pixels;

a data driver to supply the display unit with data signals;

a scan driver to supply the display unit with scan signals; and a timing controller to control the data driver and the scan driver, wherein the scan driver includes first through n-th (where n is a natural number greater than or equal to 2) scan signal output circuits to apply the scan signals to the display unit through scan lines, respectively, the scan lines being connected to pixels operable to display an image during a frame, and wherein each of the first to n-th scan signal output circuits comprises:

a drive circuit to apply a first drive signal to a first drive node, to apply a second drive signal to a second drive node, and to apply a connection signal to a connection signal output node based on i) an input signal which is one of either a scan start signal or a scan signal applied by another scan signal output circuit, ii) a clock signal, and iii) an on-level voltage; and a buffer circuit to receive the connection signal, the first drive signal, and the second drive signal from the drive circuit, and to output one of the scan signals to one of the scan lines based on the first drive signal, the second drive signal, and the clock signal, wherein:

the frame has a display period and a porch period after the display period;

the first to n-th scan signal output circuits being operable to output the scan signals through respective scan lines during the display period to allow the pixels to display the image; and the buffer circuit is operable to:

select one of the scan lines by charging a sampling node in response to a control signal enabled in the display period; and output the one scan signal to the selected scan line in response to a voltage of the sampling node in the porch period.

11. The display device of claim 10, wherein:

the buffer circuit is operable to select the one scan line by transferring the connection signal of another one of the first to n-th scan signal output circuits to the sampling node to charge the sampling node in response to the control signal.

12. The display device of claim 10, wherein the first to n-th scan signal output circuits are operable to sequentially output the scan signals through the scan lines during a threshold voltage sensing period.

13. The display device of claim 12, wherein the timing controller is operable to supply the scan driver with the clock signal including a first clock signal, a second clock signal, a third clock signal, and a fourth clock signal, and wherein each of the first to n-th scan signal output circuits is operable to receive at least two clock signals of the first to fourth clock signals.

14. The display device of claim 13, wherein the drive circuit included in the m-th (where m is a natural number smaller than n) scan signal output circuit operable to receive the first clock signal and the third clock signal comprises:

a third transistor having a first terminal to receive the first clock signal, a second terminal connected to a second node, and a gate terminal connected to a first node;

a fourth transistor having a first terminal to receive the on-level voltage, a second terminal connected to the first node, and a gate terminal to receive the input signal;

a fifth transistor having a first terminal connected to the second node, a second terminal to receive the on-level voltage, and a gate terminal to receive the first clock signal;

a sixth transistor having a first terminal connected to the second node, a second terminal to receive the on-level voltage, and a gate terminal connected to the second node;

a seventh transistor having a first terminal connected to the first node, a second terminal, and a gate terminal to receive the third clock signal;

an eighth transistor having a first terminal connected to the second terminal of the seventh transistor, a second terminal connected to the connection signal output node, and a gate terminal connected to the second node;

a ninth transistor having a first terminal connected to the first node, a second terminal connected to the connection signal output node, and a gate terminal to receive the connection signal of another one of the first to n-th scan signal output circuits;

a first capacitor having a first terminal connected to the first node and a second terminal connected to the connection signal output node;

a tenth transistor having a first terminal to receive the third clock signal, a second terminal connected to the connection signal output node, and a gate terminal connected to the first node;

an eleventh transistor having a first terminal connected to the connection signal output node, a second terminal to receive an auxiliary off-level voltage, and a gate terminal connected to the second node;

a second capacitor having a first terminal connected to the second node and a second terminal to receive the auxiliary off-level voltage;

a twelfth transistor having a first terminal connected to the first node, a second terminal connected to the first drive node, and a gate terminal to receive the display-on signal; and a thirteenth transistor having a first terminal connected to the second node, a second terminal connected to the second drive node, and a gate terminal to receive the display-on signal.

15. The display device of claim 14, wherein the fourth transistor included in the first scan signal output circuit is operable to receive the scan start signal as the input signal, and wherein the fourth transistors that are included in the second to n-th scan signal output circuits are operable to receive scan signals applied by the first to n−1-th scan signal output circuits, respectively, as the input signal.

16. The display device of claim 14, wherein the fourth transistor included in the first and second scan signal output circuits is operable to receive the scan start signal as the input signal, and wherein the fourth transistor included in the i-th (where i is a natural number greater than or equal to 3 and smaller than or equal to n) scan signal output circuit is operable to receive a scan signal applied by the i−2-th scan signal output circuit as the input signal.

17. The display device of claim 14, wherein the buffer circuit included in the m-th scan signal output circuit comprises:

a fourteenth transistor having a first terminal to receive the connection signal of the another one of the first to n-th scan signal output circuits, a second terminal connected to a sampling node, and a gate terminal to receive a sensing-on signal;

a third capacitor having a first terminal connected to the sampling node and a second terminal connected to the auxiliary off-level voltage;

a fourth capacitor having a first terminal connected to the sampling node and a second terminal to receive the sensing-on signal;

a fifteenth transistor having a first terminal to receive a sensing mode activation clock signal, a second terminal connected to a third node, and a gate terminal connected to the sampling node;

a sixteenth transistor having a first terminal connected to the second drive node, a second terminal, and a gate terminal to receive the sensing mode activation clock signal;

a seventeenth transistor having a first terminal connected to the second terminal of the sixteenth transistor, a second terminal connected to an off-level voltage higher than the auxiliary off-level voltage, and a gate terminal connected to the sampling node;

an eighteenth transistor having a first terminal connected to the third node, a second terminal connected to the first drive node, and a gate terminal connected to the sampling node;

a nineteenth transistor having a first terminal connected to the third node, a second terminal that is connected to the connection signal output node, and a gate terminal connected to the first drive node;

a first transistor having a first terminal to receive a third clock signal, a second terminal to output the one of the scan signals, and a gate terminal connected the first drive node; and a second transistor having a first terminal to output the one of the scan signals, a second terminal connected to the off-level voltage, and a gate terminal connected to the second drive node.

18. The display device of claim 17, wherein each of the plurality of pixels comprises:

a light emitting element;

a drive transistor to control the amount of current flowing through the light emitting element based on one of the data signals;

a switching transistor having a gate terminal connected to one of the scan lines to receive the data signal; and a sensing transistor having a gate terminal connected to one of the scan lines and being connected to a first terminal of the light emitting element.

* * * * *